US009443538B2

(12) United States Patent
Kato et al.

(10) Patent No.: US 9,443,538 B2
(45) Date of Patent: Sep. 13, 2016

(54) WAVEFORM PROCESSING DEVICE, WAVEFORM PROCESSING METHOD, AND WAVEFORM PROCESSING PROGRAM

(75) Inventors: Masanori Kato, Tokyo (JP); Reishi Kondo, Tokyo (JP); Yasuyuki Mitsui, Tokyo (JP)

(73) Assignee: NEC Corporation, Tokyo (JP)

( * ) Notice: Subject to any disclaimer, the term of this patent is extended or adjusted under 35 U.S.C. 154(b) by 134 days.

(21) Appl. No.: 14/131,460

(22) PCT Filed: Jun. 26, 2012

(86) PCT No.: PCT/JP2012/004128
§ 371 (c)(1),
(2), (4) Date: Jan. 8, 2014

(87) PCT Pub. No.: WO2013/011634
PCT Pub. Date: Jan. 24, 2013

(65) Prior Publication Data

US 2014/0136192 A1 May 15, 2014

(30) Foreign Application Priority Data

Jul. 19, 2011 (JP) ..... 2011-158298

(51) Int. Cl.
*G10L 25/90* (2013.01)
*G10L 13/033* (2013.01)
(Continued)

(52) U.S. Cl.
CPC ..... *G10L 25/90* (2013.01); *G10L 13/033* (2013.01); *G10L 13/06* (2013.01); *G10L 13/07* (2013.01)

(58) Field of Classification Search
None
See application file for complete search history.

(56) References Cited

U.S. PATENT DOCUMENTS

2005/0125227 A1 6/2005 Kamai et al.

FOREIGN PATENT DOCUMENTS

| | | | |
|---|---|---|---|
| CN | 1692402 | A | 11/2005 |
| JP | H02-137889 | A | 5/1990 |
| JP | H09-244693 | A | 9/1997 |

(Continued)

OTHER PUBLICATIONS

International Search Report corresponding to PCT/JP2012/004128, dated Sep. 18, 2012 (5 pages).

(Continued)

*Primary Examiner* — Vincent Rudolph
*Assistant Examiner* — Richa Mishra
(74) *Attorney, Agent, or Firm* — Wilmer Cutler Pickering Hale and Dorr LLP

(57) ABSTRACT

There is provided a waveform processing device for changing power of each pitch waveform of a segment in order to acquire a natural synthesis speech. A power calculation means 71 selects pitch waveforms one by one from a group of pitch waveforms corresponding to a segment, and calculates a scalar indicating power of a selected pitch waveform. A normalization degree calculation means 72 calculates a degree of normalization which is an index indicating a degree of normalization of a pitch waveform selected by the power calculation means 71, as a function value of an increasing function using the scalar as a variable. A change coefficient calculation means 73 calculates a change coefficient for changing an amplitude value of a pitch waveform selected by the power calculation means 71 based on the scalar and the degree of normalization. An amplitude change means 74 multiplies an amplitude value at each sampling point of a pitch waveform selected by the power calculation means 71 by the change coefficient.

7 Claims, 10 Drawing Sheets

(51) Int. Cl.
*G10L 13/06* (2013.01)
*G10L 13/07* (2013.01)

(56) References Cited

FOREIGN PATENT DOCUMENTS

| | | | | |
|---|---|---|---|---|
| JP | 3660937 | B2 | | 6/2005 |
| JP | 2008-015361 | A | | 1/2008 |
| JP | 2008015361 | A | * | 1/2008 |
| WO | WO-2004-049304 | A1 | | 6/2004 |

OTHER PUBLICATIONS

Written Opinion (PCT/ISA/237) corresponding to PCT/JP2012/004128, dated Sep. 18, 2012 (3 pages).

* cited by examiner

WAVEFORM PROCESSING DEVICE, WAVEFORM PROCESSING METHOD, AND WAVEFORM PROCESSING PROGRAM

CROSS-REFERENCE TO RELATED APPLICATIONS

This application is a national stage application of International Application No. PCT/JP2012/0004128 entitled "Waveform Processing Device, Waveform Processing Method, and Waveform Processing Program," filed on Jun. 26, 2012, which claims the benefit of the priority of Japanese patent application No. 2011-158298, filed on Jul. 19, 2011, the disclosures of each of which are hereby incorporated by reference in their entirety.

TECHNICAL FIELD

The present invention relates to a waveform processing device, a waveform processing method, and a waveform processing program, and particularly to a waveform processing device for changing power of a waveform, a waveform processing method, and a waveform processing program.

BACKGROUND ART

A waveform of a speech is indicated by a time on a horizontal axis and an amplitude on the vertical axis.

A waveform of a speech is prepared for each segment based on previously-recorded speaker's speech for speech synthesis. Waveforms of segments according to a speech to be output are coupled thereby to acquire a synthesis speech.

A waveform of a speech of each segment is cut out at a pitch cycle. The cut-out waveform is called pitch waveform. A pitch waveform is cut out from the waveform of one segment at the pitch cycle, and a plurality of pitch waveforms are generated per segment. The pitch cycle is the reciprocal of a pitch frequency (fundamental frequency).

As a method for eliminating unbalanced power of a synthesis speech, there is considered a method for performing a compression processing on a recorded speech or synthesis speech. FIG. 11 is a schematic diagram illustrating an exemplary compression processing on a waveform of a speech. A power envelope of a waveform 91 of a speech before being subjected to the compression processing can be schematically expressed as in a power envelope 92. The power envelope of the waveform of the speech looks like a power envelope 93 by the compression processing.

PLT 1 describes a speech synthesis device therein. The speech synthesis device described in PLT 1 performs a waveform normalization processing as described below. That is, the speech synthesis device described in PLT 1 takes out an 1-pitch waveform. Assuming the waveform as x[i] (i=1, . . . , N), an average amplitude $P_x$ is expressed as in Equation (1).

[Math. 1]

$$P_X = \sqrt{\frac{1}{N}\left\{\sum_{i=1}^{N}(X[i])^2\right\}} \qquad \text{Equation (1)}$$

The speech synthesis device described in PLT 1 calculates Equation (2) described later assuming a predetermined value A, thereby to acquire normalized waveform information S[i].

$$S[i]=X[i]\times A/P_x \qquad \text{Equation (2)}$$

CITATION LIST

Patent Literature

PLT1: Japanese Patent Application Laid-Open No. 2008-15361 (paragraphs 0075 to 0079)

SUMMARY OF INVENTION

Technical Problem

Power of a speech recorded for acquiring a waveform of the speech per segment variously changes due to a speech recording condition or a speaker's habit. When a synthesis speech is generated by use of a waveform generated from the recorded speech, power unbalance occurs in which power is remarkably large at a portion on the horizontal axis (time axis). Consequently, a mumbled synthesis speech is generated.

As described above, a compression processing is considered as a method for eliminating unbalanced power of a synthesis speech. However, with the compression processing, waveforms having an amplitude value lower than a threshold are not changed, and waveforms having an amplitude of the threshold or more are changed to have a constant amplitude value. In other words, the waveforms having an amplitude of the threshold or more are changed to be flat. Therefore, there is a problem that a distortion occurs in a speech waveform in the compression processing and sound quality is deteriorated.

With the normalization processing described in PLT 1, Equation (2) is calculated assuming i=1, . . . , N, thereby to change power of the waveform. Therefore, a distortion does not occur in the waveform.

However, when the normalization processing described in PLT 1 is performed on a plurality of pitch waveforms previously generated for one segment, maximum amplitudes of the respective pitch waveforms are uniform. In order to acquire a natural synthesis speech, it is preferable to maintain pitch waveforms having a small amplitude to have a relatively smaller amplitude than other pitch waveforms.

It is therefore an object of the present invention to provide a waveform processing device for changing power of each pitch waveform of a segment so as to acquire a natural synthesis speech, a waveform processing method, and a waveform processing program.

Solution to Problem

A waveform processing device according to the present invention includes a power calculation means for selecting pitch waveforms one by one from a group of pitch waveforms corresponding to a segment, and calculating a scalar indicating power of a selected pitch waveform, a normalization degree calculation means for calculating a degree of normalization which is an index indicating a degree of normalization of a pitch waveform selected by the power calculation means, as a function value of an increasing function using the scalar as a variable, a change coefficient calculation means for calculating a change coefficient for changing an amplitude value of a pitch waveform selected by the power calculation means based on the scalar and the degree of normalization, and an amplitude change means for multiplying an amplitude at each sampling point of a pitch waveform selected by the power calculation means by the change coefficient.

A waveform processing method according to the present invention includes the steps of selecting pitch waveforms one by one from a group of pitch waveforms corresponding to a segment and calculating a scalar indicating power of a selected pitch waveform, calculating a degree of normalization which is an index indicating a degree of normalization of a selected pitch waveform, as a function value of an increasing function using the scalar as a variable, calculating a change coefficient for changing an amplitude value of a selected pitch waveform based on the scalar and the degree of normalization, and multiplying an amplitude value at each sampling point of a selected pitch waveform by the change coefficient.

A waveform processing program according to the present invention causes a computer to perform a power calculating processing of selecting pitch waveforms one by one from a group of pitch waveforms corresponding to a segment, and calculating a scalar indicating power of a selected pitch waveform, a normalization degree calculation processing of calculating a degree of normalization which is an index indicating a degree of normalization of a pitch waveform selected in the power calculation processing, as a function value of an increasing function using the scalar as a variable, a change coefficient calculation processing of calculating a change coefficient for changing an amplitude value of a pitch waveform selected in the power calculation processing based on the scalar and the degree of normalization, and an amplitude change processing of multiplying an amplitude value at each sampling point of a pitch waveform selected in the power calculation processing by the change coefficient.

Advantageous Effects of Invention

According to the present invention, it is possible to change power of each pitch waveform of a segment so as to acquire a natural synthesis speech.

DESCRIPTION OF EMBODIMENTS

Exemplary embodiments according to the present invention will be described below with reference to the drawings.

When a plurality of pitch waveforms corresponding to one segment are normalized in the method described in PLT 1, maximum amplitudes of the respective pitch waveforms are uniformed. The normalization will be called complete normalization. According to the present invention, there is calculated a defined value for defining an intermediate form between a form in which a plurality of pitch waveforms corresponding to one segment are completely normalized and a form in which normalization is not performed at all to maintain the original pitch waveforms. The defined value is denoted as degree of normalization below. The degree of normalization may be an index indicating a degree of normalization. According to the present invention, power of a pitch waveform is changed according to the degree of normalization.

First Exemplary Embodiment

Figure 1:
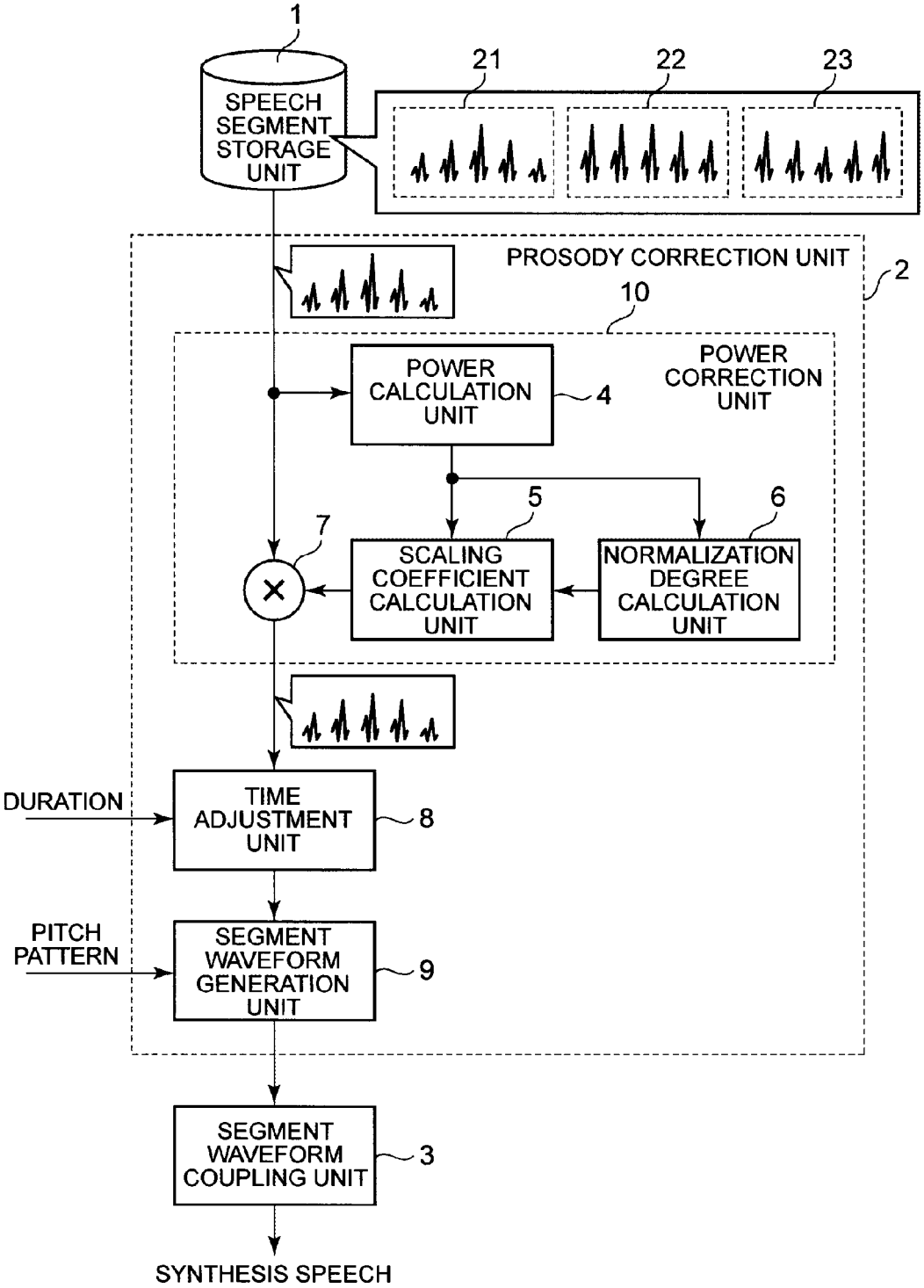
FIG. 1 It depicts a block diagram illustrating an example according to a first exemplary embodiment of the present invention.

FIG. 1 is a block diagram illustrating an example according to a first exemplary embodiment of the present invention. A waveform processing device according to the first exemplary embodiment includes a speech segment storage unit 1, a prosody correction unit 2, and a segment waveform coupling unit 3 as illustrated in FIG. 1.

The speech segment storage unit 1 is a storage device for storing a plurality of pitch waveforms per segment. A unit of segment will be described herein. For a syllable of a vowel only in a speech, the first half and the second half of the vowel are assumed as one segment (a unit of segment), respectively. For a syllable of a vowel following a consonant, the consonant and the first half of the vowel following the same are assumed as one segment, and the second half of the vowel is assumed as one segment. A waveform of a recorded speech is cut out per segment. A waveform per segment is divided by a pitch cycle thereby to generate pitch waveforms. The pitch cycle can be found as a time between a peak of a waveform and its next peak thereof, for example. When a waveform of one segment is divided into pitch waveforms, a waveform in which a peak is present at the middle and power at both ends of the waveform is smaller than the peak may be cut out as a pitch waveform.

In FIG. 1, groups of pitch waveforms 21, 22, and 23 are schematically illustrated as exemplary groups of pitch waveforms per segment stored in the speech segment storage unit 1. The group of pitch waveforms 21 corresponds to one segment. The groups of pitch waveforms 22 and 23 correspond to one segment, respectively.

The present example assumes that the speech segment storage unit 1 also stores duration per segment when a waveform of a segment is generated without thinning or insertion between pitch waveforms.

Figure 2:
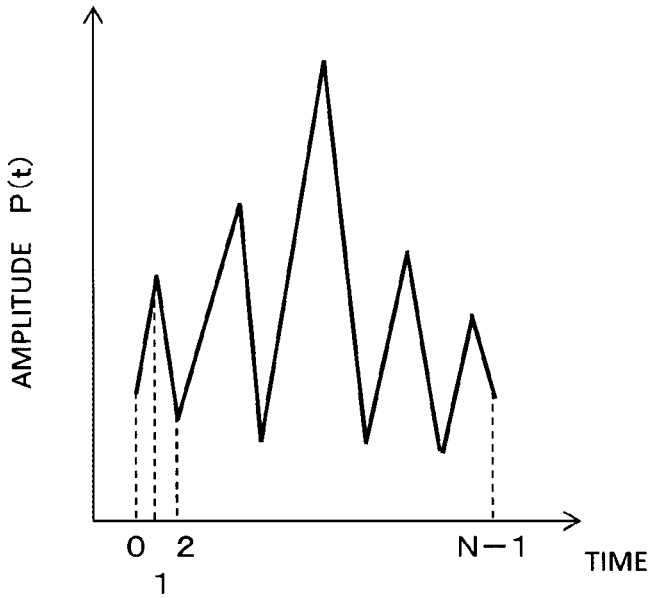
FIG. 2 It depicts an explanatory diagram schematically illustrating an exemplary pitch waveform.

FIG. 2 is an explanatory diagram schematically illustrating an exemplary pitch waveform. The pitch waveform is sampled along the horizontal axis (time axis). It is assumed that the pitch waveform illustrated in FIG. 2 is sampled N times from 0 to N−1. The number of sampling times N can be assumed as a length of one pitch waveform. An amplitude value at t is assumed as P(t) at t=0, 1, 2, . . . , N−1. At t=0, 1, 2, . . . , N−1, a pitch waveform having the amplitude value P(t) may be expressed as {P(t):t=0, 1, 2, . . . , N−1}.

The prosody correction unit 2 changes power of a pitch waveform belonging to the group of pitch waveforms per segment. Further, thinning or insertion is performed between pitch waveforms according to duration when the segment is output, and the pitch waveforms are coupled (overlapped and added) thereby to generate a waveform of one segment.

The segment waveform coupling unit 3 couples waveforms per segment generated by the prosody correction unit 2, thereby generating a synthesis speech.

The prosody correction unit 2 includes a power correction unit 10, a time adjustment unit 8, and a segment waveform generation unit 9.

The power correction unit 10 reads a group of pitch waveforms stored in the speech segment storage unit 1 per segment. The power correction unit 10 calculates a degree of normalization of each pitch waveform corresponding to one segment. The power of the pitch waveform is changed based on the degree of normalization found for the pitch waveform. In other words, the power is corrected based on the degree of normalization.

Specifically, the power correction unit 10 includes a power calculation unit 4, a normalization degree calculation unit 6, a scaling coefficient calculation unit 5, and a multiplier 7.

The power calculation unit 4 reads a group of pitch waveforms per segment from the speech segment storage unit 1. The power calculation unit 4, the normalization degree calculation unit 6, the scaling coefficient calculation unit 5, and the multiplier 7 perform processings per pitch waveform belonging to the group of pitch waveforms of one segment. The power calculation unit 4 reads the group of pitch waveforms per segment in an order of segments in a synthesis speech, for example.

The power calculation unit 4 calculates a scalar S indicating power of a pitch waveform of interest. There will be described herein a case in which an average amplitude is calculated as the scalar S indicating power. Assuming a pitch waveform as {P(t):t=0, 1, 2, . . . , N−1}, the power calculation unit 4 may calculate an average amplitude S by calculating Equation (3) described below.

[Math. 2]

$$S = \sqrt{\frac{1}{N}\left\{\sum_{t=0}^{N-1}(P(t))^2\right\}} \qquad \text{Equation (3)}$$

The scalar S indicating power is not limited to the average amplitude, and the power calculation unit 4 may calculate other value for the scalar S indicating power. Other exemplary scalar S indicating power will be described below.

The normalization degree calculation unit 6 calculates a degree of normalization as a function value of an increasing function with the scalar S indicating power (average amplitude in the present example) as a variable. Assuming a degree of normalization α and an increasing function A(S) with the scalar S indicating power as a variable, α=A(S) is established. As described above, the degree of normalization is a defined value for defining an intermediate form between a form in which a plurality of pitch waveforms corresponding to one segment are completely normalized and a form in which normalization is not performed at all to maintain the original pitch waveforms.

α is a real number meeting 0.0≤α≤1.0. An increasing function used as A(S) may be a step function, a polygonal line function, or a sigmoid function, for example. The present example will be described assuming the increasing function A(S) as a polygonal line function. For example, the normalization degree calculation unit 6 may find a degree of normalization α by calculating a value according to the average amplitude S calculated by the power calculation unit 4, by use of the function A(S) in Equation (4) described later.

[Math. 3]

$$A(S) = \begin{cases} \alpha_{min} & \text{if } S \leqq S_1 \\ \dfrac{\alpha_{max} - \alpha_{min}}{S_2 - S_1}(S - S_1) + \alpha_{min} & \text{if } S_1 < S < S_2 \\ \alpha_{max} & \text{if } S_2 \leqq S \end{cases} \qquad \text{Equation (4)}$$

Figure 3:
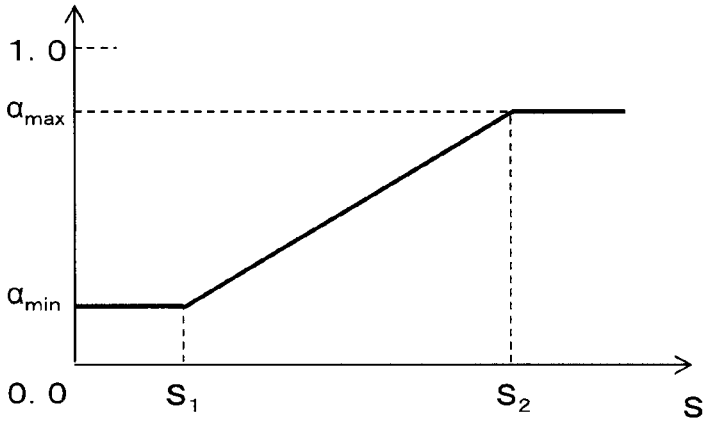
FIG. 3 It depicts an explanatory diagram illustrating a function expressed in Equation (4).

The function expressed in Equation (4) is expressed as in FIG. 3. $\alpha_{min}$ and $\alpha_{max}$ in Equation (4) may be previously defined as constants meeting $\alpha_{min} \leq \alpha_{max}$. Similarly, $S_1$ and $S_2$ may be previously defined as constants meeting $S_1 < S_2$. Equation (4) is an exemplary polygonal line function, and the increasing function α=A(S) may be a polygonal line function expressed in an equation other than Equation (4). Alternatively, the increasing function may not be a polygonal line function.

The scaling coefficient calculation unit 5 calculates a scaling coefficient as a function value of a function using the scalar S (average amplitude in the present example) indicating power and the degree of normalization α as variables. The scaling coefficient is multiplied by the amplitude value P(t) at each sampling point of a pitch waveform. P(t) is multiplied by the scaling coefficient thereby to change (correct) the power of the pitch waveform.

Assuming a scaling coefficient g and a function G(S, α) indicating the scaling coefficient, g=G(S, α) is established. A predefined constant is assumed as C. The scaling coefficient calculation unit 5 calculates the scaling coefficient g meeting a condition of (C/S)≤g≤1.0.

The scaling coefficient calculation unit 5 may find a scaling coefficient g by substituting the average amplitude S and the degree of normalization α into the function G(S, α) in Equation (5) described below, for example.

[Math. 4]

$$G(S, \alpha) = (1 - \alpha) + \alpha \times \frac{C}{S} \qquad \text{Equation (5)}$$

C in Equation (5) is a predefined constant as described above.

One scaling coefficient is found for one pitch waveform by the processings in the power calculation unit 4, the normalization degree calculation unit 6 and the scaling coefficient calculation unit 5.

The multiplier 7 multiplies an amplitude value of a pitch waveform of interest by the scaling coefficient g calculated by the scaling coefficient calculation unit 5 thereby to change the power of the pitch waveform. That is, assuming the pitch waveform as {P(t):t=0, 1, 2, . . . , N−1}, the multiplier 7 calculates Equation (6) described below for each of t=0, 1, 2, . . . , N−1, thereby changing the power.

$$P(t)'=P(t)\times g \qquad \text{Equation (6)}$$

P(t)' is a corrected amplitude value at each sampling point.

The time adjustment unit 8 is input with duration when a segment is output for each segment. The time adjustment unit 8 performs thinning or insertion between pitch waveforms for the group of corrected pitch waveforms based on a rate between the duration predefined for the group of power-corrected pitch waveforms and input duration. A pitch waveform to be inserted may be the same as the acquired pitch waveform.

A pitch pattern is input into the segment waveform generation unit 9. The pitch pattern is a time series of a pitch frequency. The segment waveform generation unit 9 couples pitch waveforms per segment according to the pitch frequency indicated by the pitch pattern. The segment waveform generation unit 9 may calculate a pitch cycle by calculating the reciprocal of the pitch frequency, and may couple the groups of pitch waveforms per segment according to the pitch cycle.

In coupling pitch waveforms, a determination may be made as follows, for example, as to from which pitch frequency contained in the pitch pattern (time series of the pitch frequency) the pitch cycle is to be calculated. For example, a time series in which the pitch frequency and a time elapsed from a reference point of time are associate may be input as the pitch pattern. The segment waveform generation unit 9 determines an order of pitch waveforms in a synthesis speech, and may calculate a pitch cycle to be used for coupling pitch waveforms by use of the pitch frequency corresponding to an elapsed time in the order of pitch waveforms.

The power calculation unit 4, the normalization degree calculation unit 6, the scaling coefficient calculation unit 5, the multiplier 7, the time adjustment unit 8, the segment waveform generation unit 9, and the segment waveform coupling unit 3 are realized in a CPU of a computer operating according to a waveform processing program, for example. In this case, a program storage device (not illustrated) in the computer stores the waveform processing program therein, and the CPU may read the program and may operate as the power calculation unit 4, the normalization degree calculation unit 6, the scaling coefficient calculation unit 5, the multiplier 7, the time adjustment unit 8, the segment waveform generation unit 9 and the segment waveform coupling unit 3 according to the program. Each constituent may be realized in an individual unit.

The operations will be described below.

Figure 4:
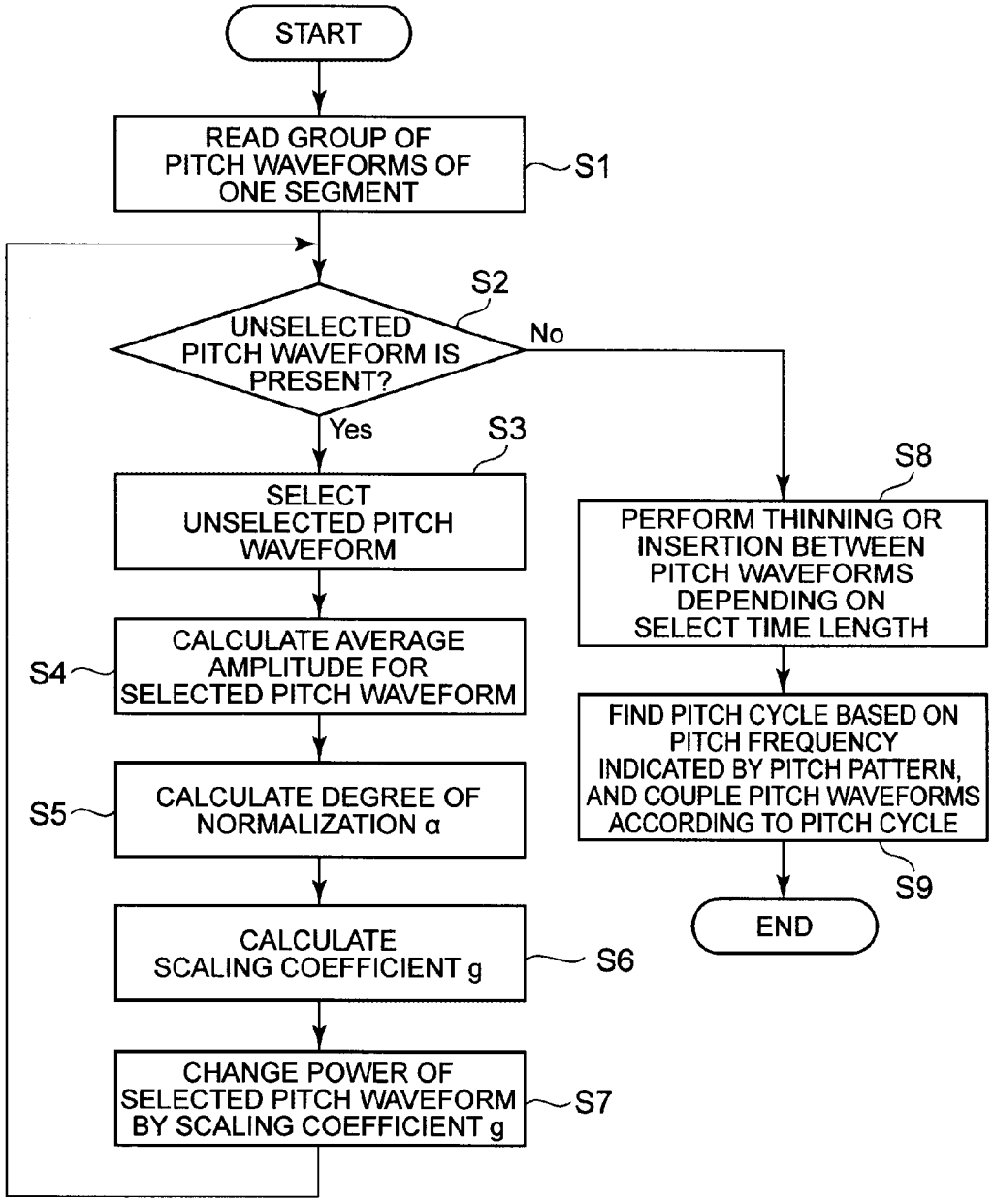
FIG. 4 It depicts a flowchart illustrating an exemplary processing of synthesizing pitch waveforms for one segment.

FIG. 4 is a flowchart illustrating an exemplary processing of synthesizing pitch waveforms for one segment. The speech segment storage unit 1 is assumed to previously store a group of pitch waveforms per segment therein.

The power calculation unit 4 reads a group of pitch waveforms of one segment from the speech segment storage unit 1 (step S1). The power calculation unit 4 determines whether an unselected pitch waveform is present in the group of pitch waveforms of one segment read in step S1 (step S2). When an unselected pitch waveform is present (Yes in step S2), the processing proceeds to step S3. Since no pitch waveform is selected when the processing proceeds from step S1 to step S2, the processing proceeds to step S3.

In step S3, the power calculation unit 4 selects one unselected pitch waveform from the group of pitch waveforms of one segment read in step S1 (step S3).

Then, the power calculation unit 4 calculates a scalar S indicating power for a selected pitch waveform (step S4). The present example will be described assuming that an average amplitude is calculated as the scalar S indicating power. The power calculation unit 4 calculates Equation (3) for a selected pitch waveform, and may calculate an average amplitude S of the pitch waveform.

Then, the normalization degree calculation unit 6 calculates a degree of normalization α based on the average amplitude S (step S5). In the present example, it is assumed that the function expressed in Equation (4) is previously defined as an increasing function A(S) using the average amplitude S as a variable. The normalization degree calculation unit 6 may calculate a degree of normalization α(=A(S)) depending on the average amplitude S calculated in step S4 by use of the function A(S) expressed in Equation (4).

After step S5, the scaling coefficient calculation unit 5 calculates a scaling coefficient for the group of pitch waveforms selected in step S1 based on the average amplitude S and the degree of normalization α (step S6). In the present example, it is assumed that the function expressed in Equation (5) is previously defined as a function G(S, α) indicating the scaling coefficient. The normalization degree calculation unit 6 may calculate the scaling coefficient by substituting the average amplitude S calculated in step S4 and the degree of normalization α calculated in step S5 into G(S, α).

Then, the multiplier 7 uses the scaling coefficient g calculated in step S6 thereby to change power of the pitch waveform selected in step S3 (step S7). When the selected pitch waveform is expressed as {P(t):t=0, 1, 2, . . . , N−1}, the multiplier 7 calculates Equation (6) for t=0, 1, 2, . . . , N−1, respectively, and may calculate a corrected amplitude value P(t)' at each sampling point. The correction for the waveforms selected in step S3 is completed by the processing in step S7.

After step S7, the power correction unit 10 repeats the operations subsequent to step S2.

In step S2, it is determined that an unselected pitch waveform is not present (No in step S2), the processing proceeds to step S8. The absence of an unselected pitch waveform means that all the pitch waveforms belonging to the group of pitch waveforms of one segment read in step S1 are selected and the pitch waveforms are completely changed.

The time adjustment unit 8 is input with duration when a segment is output as a synthesis speech. The time adjustment unit 8 calculates a rate between the duration predefined for the group of pitch waveforms of one segment read in step S1 and input duration. The time adjustment unit 8 performs thinning or insertion between pitch waveforms on the group of corrected pitch waveforms based on the rate (step S8). The predefined duration is of a segment when waveforms of the segment are generated without thinning or insertion between pitch waveforms.

Figure 5:
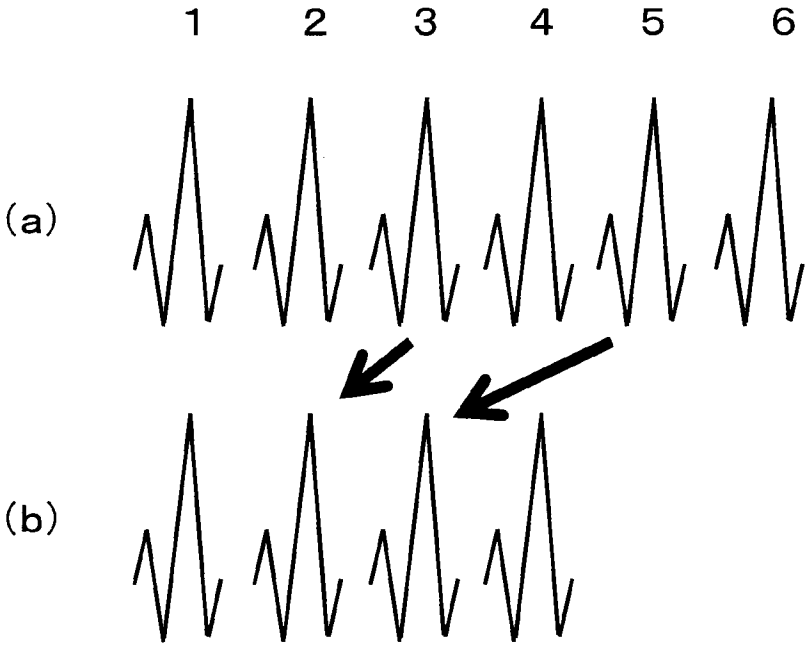
FIG. 5 It depicts an explanatory diagram illustrating exemplary thinning between pitch waveforms.
Figure 6:
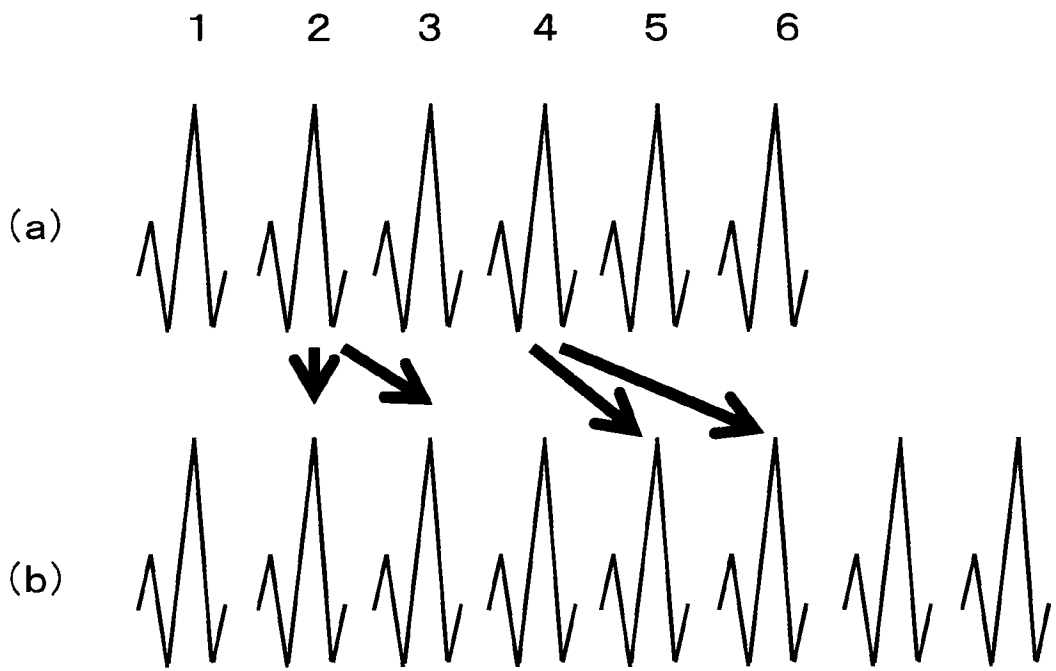
FIG. 6 It depicts an explanatory diagram illustrating exemplary insertion between pitch waveforms.

FIG. 5 is an explanatory diagram illustrating exemplary thinning between pitch waveforms, and FIG. 6 is an explanatory diagram illustrating exemplary insertion between pitch waveforms. FIG. 5(*a*) illustrates each pitch waveform before thinning, and FIG. 6(*a*) illustrates each pitch waveform before insertion. The present example assumes that six pitch waveforms belong to a group of pitch waveforms per segment (see FIG. 5(*a*) and FIG. 6(*a*)). The numbers 1 to 6 indicated in FIG. 5(*a*) and FIG. 6(*a*) indicate an order of the pitch waveforms. A maximum amplitude is common among the pitch waveforms in FIG. 5 and FIG. 6, but the maximum amplitude is not necessarily common among the pitch waveforms.

Exemplary thinning will be described with reference to FIG. 5. It is assumed that input duration (duration when a segment is output as a synthesis speech) is 0.66 times longer than the predefined duration. In this case, the time adjustment unit 8 excludes the second and fourth pitch waveforms as illustrated in FIG. 5, and moves forward the third, fifth and sixth pitch waveforms to the second to fourth (see FIG. 5(*b*)). Consequently, the number of pitch waveforms decreases from six to four, and the duration of the segment is 0.66 times longer than when thinning is not performed.

Exemplary insertion will be described with reference to FIG. 6. It is assumed that the input duration is 1.33 times longer than the predefined duration. In this case, the time adjustment unit 8 inserts, after the second pitch waveform, the same pitch waveform as the second pitch waveform as illustrated in FIG. 6. Similarly, the same pitch waveform as the fourth pitch waveform is inserted after the fourth pitch waveform. Consequently, the number of pitch waveforms increases from six to eight, and the duration of the segment is 1.33 times longer than when insertion is not performed.

Thinning and insertion are not limited to the examples illustrated in FIG. 5 and FIG. 6. Rules for thinning and insertion may be previously defined as to what number pitch waveform is to be excluded or the same pitch waveform as what number pitch waveform is to be inserted when the input duration is what times longer than the predefined duration.

After step S8, the segment waveform generation unit 9 specifies a pitch frequency corresponding to a pitch waveform read in step S1 from among the input pitch frequencies and calculates the reciprocal of the pitch frequency, thereby calculating a pitch cycle. Individual pitch waveforms are coupled according to the pitch cycle (step S9).

When the pitch waveforms are coupled (overlapped and added), they may be overlapped and added by use of an offset corresponding to the pitch cycle. For example, it is assumed that the first pitch waveform is $P_1(t)$, the second pitch waveform is $P_2(t)$, and an offset corresponding to the pitch cycle from the first pitch waveform to the second pitch waveform is T. In this case, the segment waveform generation unit 9 calculates $P_1(t)+P_2(t+T)$ thereby to acquire a coupled pitch waveform. The third and subsequent pitch waveforms may be similarly overlapped and added by reflecting the offset. In the coupled waveform, an interval between a peak and its next peak is long at a long pitch cycle, and an interval between a peak and its next peak is short at a short pitch cycle.

In coupling the pitch waveforms, around the end point of a former pitch waveform and around the start point of its next pitch waveform may be overlapped on the time axis. In this case, the segment waveform generation unit 9 may add the amplitude values between around the end point of the former pitch waveform and around the start point of its next pitch waveform.

A waveform of the segment are finally generated through steps S1 to S9 described above.

The prosody correction unit 2 may perform the processings in step S1 to S9 described above per segment in an order of segments used for a synthesis speech.

The segment waveform coupling unit 3 couples the waveforms of each segment in an order of segments used in a synthesis speech. The segment waveform coupling unit 3 may overlap and add the waveforms by use of an offset corresponding to the duration. For example, it is assumed that the waveform of the first phoneme is $X_1(t)$ and the waveform of the second phoneme is $X_2(t)$. An offset corresponding to the duration of the first phoneme is assumed as R. In this case, the segment waveform coupling unit 3 calculates $X_1(t)+X_2(t+R)$ thereby to acquire a coupled waveform. The waveforms of the third and subsequent phonemes may be similarly overlapped and added by reflecting the offset. Around the end point of the waveform of a former phoneme and around the start point of the waveform of its next phoneme may be overlapped. In this case, the segment waveform coupling unit 3 may add the amplitude values between around the end point of the waveform of the former phoneme and around the start point of the waveform of its next phoneme.

According to the present invention, the function A(S) used for calculating a degree of normalization $\alpha$ is an increasing function. As the value of the average amplitude (the scalar indicating power) is larger, the degree of normalization is higher. That is, complete normalization is nearly accomplished. On the other hand, as the value of the average amplitude is smaller, the degree of normalization is lower and a change in power due to the change in step S7 is less. Therefore, a pitch waveform having a small amplitude can be maintained to have a relatively smaller amplitude than other pitch waveforms. Consequently, a natural synthesis speech can be acquired.

The scaling coefficient calculation unit 5 calculates a scaling coefficient g meeting a condition of $(C/S)\leq g\leq 1.0$, and the multiplier 7 changes the power by the scaling coefficient g. Therefore, even if a pitch waveform the power of which suddenly increases is acquired due to a speech recording condition or speaker's habit, unbalanced power can be prevented in the waveform of the resultant synthesis speech.

The multiplier 7 changes the power of a pitch waveform by calculating Equation (6), and thus a distortion does not occur in the changed pitch waveform, thereby preventing a reduction in sound quality.

Variants of the present invention will be described below.

A variant of the calculation of the power calculation unit 4 will be described first. In the above example, there has been described the case in which the power calculation unit 4 calculates an average amplitude as a scalar S indicating power for a pitch waveform. The power calculation unit 4 may find a scalar S indicating power by calculating Equation (7) described below.

[Math. 5]

$$S = \frac{1}{N}\left\{\sum_{t=0}^{N-1}(P(t))^2\right\} \qquad \text{Equation (7)}$$

The scalar obtained in Equation (7) is the square of the average amplitude obtained in Equation (3).

The power calculation unit 4 may find a scalar S indicating power by calculating Equation (8) described below.

[Math. 6]

$$S = \frac{1}{N}\sum_{t=0}^{N-1}|P(t)| \qquad \text{Equation (8)}$$

A variant of the increasing function $\alpha$=A(S) used by the normalization degree calculation unit 6 for finding a degree of normalization $\alpha$ will be described below. In the above example, there has been described the case in which the increasing function $\alpha=A(S)$ is a polygonal line function expressed in Equation (4). $\alpha=A(S)$ may be an increasing function, and may not be a polygonal line function. For example, the normalization degree calculation unit 6 may calculate a value depending on the scalar S (such as the average amplitude of the power) calculated by the power calculation unit 4 by use of the function A(S) in Equation (9) described below.

[Math. 7]

$$A(S) = \begin{cases} 0.0 & \text{if } S \leqq S_{th} \\ 1.0 & \text{otherwise} \end{cases} \quad \text{Equation (9)}$$

Equation (9) is a step function in which when the scalar S calculated by the power calculation unit 4 is a predefined threshold $S_{th}$ or less, $\alpha=0.0$ is established, and otherwise (or when the scalar S is more than the threshold $S_{th}$), $\alpha=1.0$ is established. The function expressed in Equation (9) may be called binary function. Equation (9) is an exemplary step function, and the increasing function $\alpha=A(S)$ may be a step function expressed in an equation other than Equation (9).

Further, $\alpha=A(S)$ may be a sigmoid function. For example, the normalization degree calculation unit 6 may calculate a degree of normalization $\alpha$ by substituting the scalar S calculated in the power calculation unit 4 into Equation (10) described below.

[Math. 8]

$$A(S) = \alpha_{min} + \frac{\alpha_{max} - \alpha_{min}}{1 + \exp(\gamma_1(S - \gamma_2))} \quad \text{Equation (10)}$$

In Equation (10), $\alpha_{min}$ and $\alpha_{max}$ may be predefined as constants meeting $\alpha_{min}<\alpha_{max}$. In Equation (10), $\gamma_1$ and $\gamma_2$ may be predefined as constants meeting Equation (11) and Equation (12) described below.

$$\gamma_1<0 \quad \text{Equation (11)}$$

$$0<S_1<\gamma_2<S_2 \quad \text{Equation (12)}$$

Figure 7:
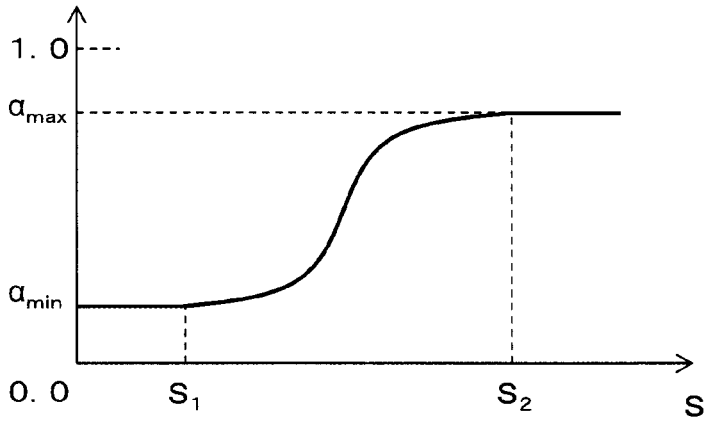
FIG. 7 It depicts an explanatory diagram illustrating a function expressed in Equation (10).

$S_1$ and $S_2$ in Equation (12) may be predefined as constants meeting $S_1<S_2$. The sigmoid function expressed in Equation (10) is indicated as in FIG. 7. Equation (10) is an exemplary sigmoid function, and the increasing function $\alpha=A(S)$ may be a sigmoid function expressed in an equation other than Equation (10).

Assuming A(S) as a sigmoid function, a change in the degree of normalization $\alpha$ is gentle, and thus a change in power is more natural.

A variant of the function $G(S, \alpha)$ used by the scaling coefficient calculation unit 5 for finding a scaling coefficient g will be described below. In the above example, there has been described the case in which the function $g=G(S, \alpha)$ is the function expressed in Equation (5). The normalization degree calculation unit 6 may calculate a scaling coefficient g depending on the scalar S (such as the average amplitude of the power) and the degree of normalization $\alpha$ by use of the polygonal line function $g=G(S, \alpha)$ in Equation (13) described later.

[Math. 9]

$$G(S, \alpha) = \begin{cases} 1.0 & \text{if } S \leqq \alpha_1 \\ \frac{C}{S} - 1.0 \\ \frac{}{\alpha_2 - \alpha_1}(\alpha - \alpha_1) + 1.0 & \text{if } \alpha_1 < S < \alpha_2 \\ \frac{C}{S} & \text{if } \alpha_2 \leqq S \end{cases} \quad \text{Equation (13)}$$

C in Equation (13) is a predefined constant. $\alpha_1$ and $\alpha_2$ in Equation (13) may be predefined as constants meeting $0.0\leq\alpha_1\leq\alpha_2\leq1.0$. The function $g=G(S, \alpha)$ may be a polygonal line function expressed in an equation other than Equation (13).

Alternatively, the normalization degree calculation unit 6 may calculate a scaling coefficient g depending on the scalar S (such as the average amplitude of the power) and the degree of normalization $\alpha$ by use of the sigmoid function $g=G(S, \alpha)$ in Equation (14) described below.

[Math. 10]

$$G(S, \alpha) = 1.0 - \frac{1.0 - \frac{C}{S}}{1 + \exp(\beta_1(\alpha - \beta_2))} \quad \text{Equation (14)}$$

C in Equation (14) is a predefined constant. $\beta_1$ and $\beta_2$ in Equation (14) may be predefined as constants meeting Equation (15) and Equation (16) described below.

$$\beta1<0 \quad \text{Equation (15)}$$

$$0\leq\alpha_1\leq\beta_2\leq\alpha_2\leq1.0 \quad \text{Equation (16)}$$

Other variant of the first exemplary embodiment employs a form in which the normalization degree calculation unit 6 switches the increasing function A(S) used for calculating a degree of normalization $\alpha$. The variant will be described below.

The normalization degree calculation unit 6 switches the increasing function A(S) used for calculating a degree of normalization $\alpha$ depending on whether a segment for which a scaling coefficient is to be calculated (or a segment corresponding to the group of pitch waveforms read in step S1) is a vowel, or contains a consonant other than voiced stop consonants (b, d, g), or contains a voiced stop consonant.

In this case, the normalization degree calculation unit 6 is input with the result of the language processing on text information for which a synthesis speech is to be output. That is, a determination is made by the language processing as to whether an individual segment corresponds to a vowel, or contains a consonant other than voiced stop consonants, or contains a voiced stop consonant, and the determination result may be input into the normalization degree calculation unit 6 in the order of the segments.

When a segment for which a scaling coefficient is to be calculated corresponds to a vowel, the normalization degree calculation unit 6 may calculate a degree of normalization $\alpha$ by use of the function A(S) in Equation (17) described below as an increasing function A(S).

[Math. 11]

$$A(S)=\begin{cases}\alpha_{min1} & \text{if } S \leqq S_1 \\ \dfrac{\alpha_{max1}-\alpha_{min1}}{S_2-S_1}(S-S_1)+\alpha_{min1} & \text{if } S_1<S<S_2 \\ \alpha_{max1} & \text{if } S_2 \leqq S\end{cases} \quad \text{Equation (17)}$$

When a segment for which a scaling coefficient is to be calculated contains a consonant other than voiced stop consonants, the normalization degree calculation unit 6 may calculate a degree of normalization α by use of the function A(S) in Equation (18) described below as an increasing function A(S).

[Math. 12]

$$A(S)=\begin{cases}\alpha_{min2} & \text{if } S \leqq S_1 \\ \dfrac{\alpha_{max2}-\alpha_{min2}}{S_2-S_1}(S-S_1)+\alpha_{min2} & \text{if } S_1<S<S_2 \\ \alpha_{max2} & \text{if } S_2 \leqq S\end{cases} \quad \text{Equation (18)}$$

When a segment for which a scaling coefficient is to be calculated contains a voiced stop consonant, the normalization degree calculation unit 6 may calculate a degree of normalization α by use of the function A(S) in Equation (19) described below as an increasing function A(S).

[Math. 13]

$$A(S)=\begin{cases}0.0 & \text{if } S \leqq S_{th} \\ 0.5 & \text{otherwise}\end{cases} \quad \text{Equation (19)}$$

$S_1$, $S_2$, and $S_{th}$ in Equation (17) to Equation (19) may be predefined as constants, respectively. $S_2$ and $S_{th}$ are defined to meet $S_2<S_{th}$. In Equation (17) and Equation (18) $\alpha_{min1}$, $\alpha_{max1}$, $\alpha_{min2}$, and $\alpha_{max2}$ may be predefined as constants meeting $\alpha_{min1}<\alpha_{max1}$ and $\alpha_{min2}<\alpha_{max2}$, respectively. $\alpha_{max1}$ and $\alpha_{max2}$ are defined to meet a condition of $\alpha_{max2}<\alpha_{max1}$. Either $\alpha_{min1}$ or $\alpha_{min2}$ may be larger.

Generally, a speech of a consonant is likely to be deteriorated along with normalization. According to the present variant, a degree of normalization of a segment containing a consonant can be restricted. The power of a voiced stop consonant can be further prevented from increasing than before the scaling. A speech deterioration of a consonant along with the scaling can be prevented.

The normalization degree calculation unit 6 may switch the increasing function A(S) used for calculating a degree of normalization α depending on whether a segment for which a scaling coefficient is to be calculated (or a segment corresponding to the group of pitch waveforms read in step S1) is within three moras from the sentence head. In this case, a determination is made, as the language processing on text information for which a synthesis speech is to be output, as to whether an individual segment is within three moras from the sentence head, and the determination result may be input into the normalization degree calculation unit 6 in the order of the segments.

When a segment for which a scaling coefficient is to be calculated is within three moras from the sentence head, the normalization degree calculation unit 6 may calculate a degree of normalization α by use of the function A(S) in Equation (20) described below as an increasing function A(S).

[Math. 14]

$$A(S)=\begin{cases}\alpha_{min1} & \text{if } S \leqq S_1 \\ \dfrac{\alpha_{max1}-\alpha_{min1}}{S_2-S_1}(S-S_1)+\alpha_{min1} & \text{if } S_1<S<S_2 \\ \alpha_{max1} & \text{if } S_2 \leqq S\end{cases} \quad \text{Equation (20)}$$

When a segment for which a scaling coefficient is to be calculated is not within three moras from the sentence head, the normalization degree calculation unit 6 may calculate a degree of normalization α by use of the function A(S) in Equation (21) described below as an increasing function A(S).

[Math. 15]

$$A(S)=\begin{cases}\alpha_{min2} & \text{if } S \leqq S_1 \\ \dfrac{\alpha_{max2}-\alpha_{min2}}{S_3-S_1}(S-S_1)+\alpha_{min2} & \text{if } S_1<S<S_3 \\ \alpha_{max2} & \text{if } S_3 \leqq S\end{cases} \quad \text{Equation (21)}$$

In Equation (20) and Equation (21), $S_1$, $S_2$, and $S_3$ may be predefined as constants meeting $S_1<S_3<S_2$. $\alpha_{min1}$, $\alpha_{max1}$, $\alpha_{min2}$, and $\alpha_{max2}$ may be predefined as constants meeting $\alpha_{min1}<\alpha_{max1}$ and $\alpha_{min2}<\alpha_{max2}$, respectively. $\alpha_{max1}$ and $\alpha_{max2}$ are defined to meet a condition of $\alpha_{max2}<\alpha_{max1}$. Either $\alpha_{min1}$ or $\alpha_{min2}$ may be larger.

A(S) used for calculating a degree of normalization α may be switched depending on not whether a segment is within three moras from the sentence head but whether a segment is within three moras from the breath group head in a breath group. That is, when a segment for which a scaling coefficient is to be calculated is within three moras from the breath group head, the normalization degree calculation unit 6 may calculate a degree of normalization α by use of Equation (20). When a segment for which a scaling coefficient is to be calculated is not within three moras from the breath group head, the normalization degree calculation unit 6 may calculate a degree of normalization α by use of Equation (21). In this case, the normalization degree calculation unit 6 may be input with the result determined per segment as to whether the segment is within three moras from the breath group head.

The power is large within three moras from the sentence head (or the breath group head). According to the present variant, a degree of normalization of a segment within three moras from the sentence head (or the breath group head) is reduced, thereby making a synthesis speech at the sentence head or the breath group head more natural.

Second Exemplary Embodiment

Figure 8:
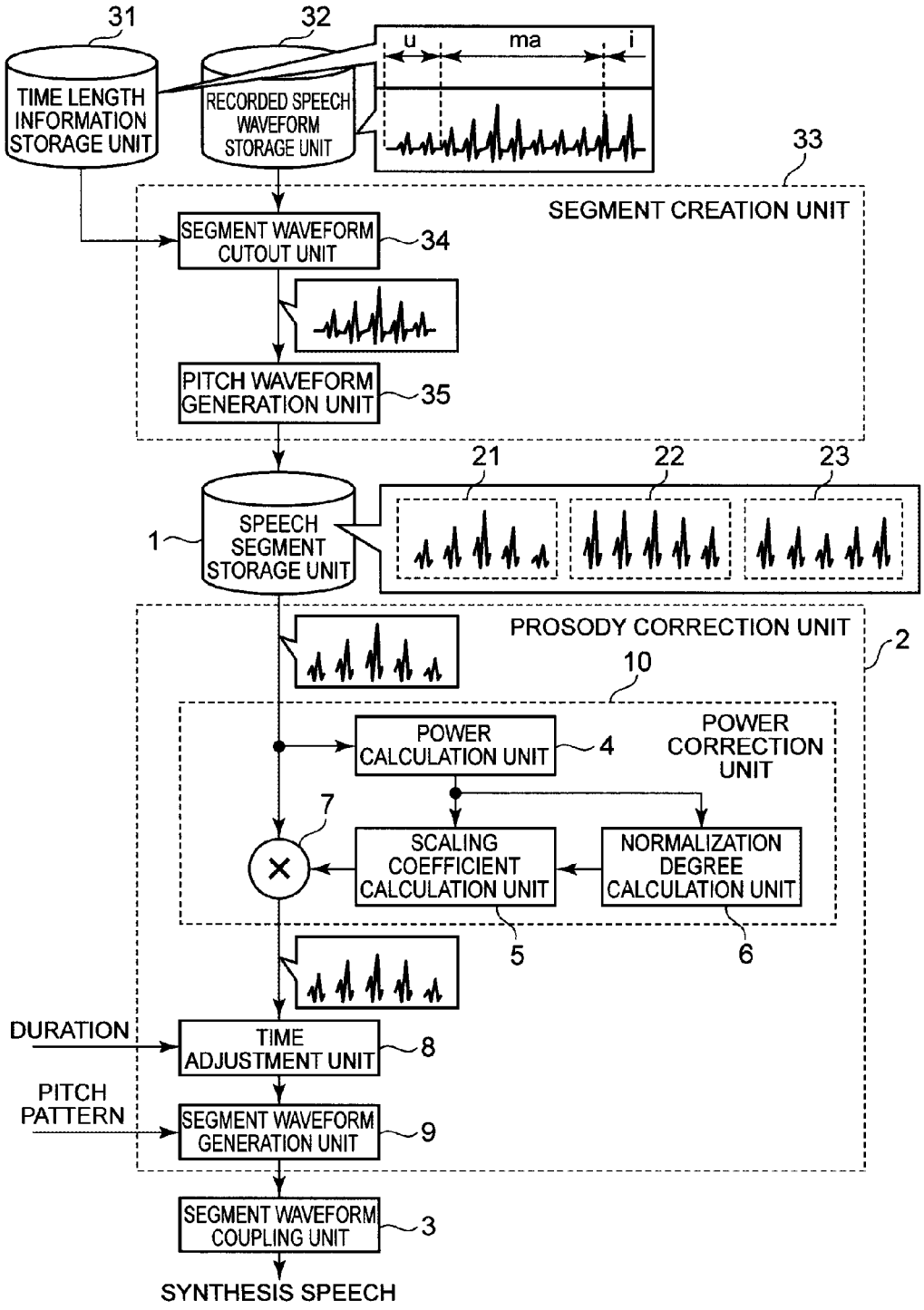
FIG. 8 It depicts a block diagram illustrating an example according to a second exemplary embodiment of the present invention.

A waveform processing device according to a second exemplary embodiment generates a group of pitch waveforms to be stored in the speech segment storage unit 1 per segment. FIG. 8 is a block diagram illustrating an example according to the second exemplary embodiment of the present invention. The same constituents as in the first exemplary embodiment are denoted with the same reference numerals as in FIG. 1, and a detailed explanation thereof will be omitted. The waveform processing device according to the second exemplary embodiment further includes a recorded speech waveform storage unit 32, a time length information storage unit 31, and a segment creation unit 33 in addition to the constituents according to the first exemplary embodiment (see FIG. 1).

The recorded speech waveform storage unit 32 is a storage device for storing a waveform of a recorded speech therein. FIG. 8 illustrates an example in which a waveform of the continuous syllables "u", "ma" and "i" is stored.

The time length information storage unit 31 is a storage device for storing a time length of each syllable of a recorded speech. That is, the time length information storage unit 31 stores a time length of each syllable corresponding to a waveform stored in the recorded speech waveform storage unit 32. For example, the time length information storage unit 31 stores a time length per syllable "u", "ma" or "i."

The segment creation unit 33 cuts out a waveform per segment from the waveforms (the waveforms of the recorded speech) stored in the recorded speech waveform storage unit 32, and further cuts out pitch waveforms per waveform of an individual segment. A group of pitch waveforms per segment is stored in the speech segment storage unit 1.

Specifically, the segment creation unit 33 includes a segment waveform cutout unit 34 and a pitch waveform generation unit 35.

The segment creation unit 33 cuts out a waveform of an individual segment from the waveforms (the waveforms of a recorded speech) stored in the recorded speech waveform storage unit 32 based on the time length of each syllable stored in the time length information storage unit 31. As described above, for syllables of vowels only, the first half and the second half of a vowel are assumed as one segment (a unit of segments), respectively. For a syllable of a vowel following a consonant, the consonant and the first half of the vowel following the same are assumed as one segment, and the second half of the vowel is assumed as one segment. Therefore, the segment creation unit 33 may cut out the first half and the second half of a syllable of a vowel only from the waveforms of a recorded speech. For a syllable made of a consonant and a vowel following the same, the consonant and the first half of the subsequent vowel may be cut out, and the second half of the vowel may be cut out. A portion corresponding to an individual syllable may be determined based on a time length of each syllable for the waveforms of a recorded speech.

For example, as illustrated in FIG. 8, the waveforms of a recorded speech (which will be simply denoted as recorded waveform below) are assumed to correspond to the syllables "u", "ma" and "i." The segment creation unit 33 specifies portions corresponding to "u", "ma" and "i" from the recorded waveforms based on each time length of "u", "ma" and "i", and cuts out the first halves and the second halves of the portions corresponding to the syllables, respectively. Consequently, a waveform per segment is acquired.

The pitch waveform generation unit 35 cuts out pitch waveforms per waveform of each segment. A plurality of peaks appear in the waveform of one segment. The pitch waveform generation unit 35 calculates an interval between the peaks as a pitch cycle. The pitch waveform generation unit 35 cuts out waveforms of a segment according to the pitch cycle, thereby acquiring a plurality of pitch waveforms (a group of pitch waveforms) for one segment. The pitch waveform generation unit 35 cuts out an individual pitch waveform such that a peak is present at the middle and power at both ends of the waveform are smaller than the peak.

The pitch waveform generation unit 35 stores a generated group of pitch waveforms in the speech segment storage unit 1 per segment.

The above example has been described by way of the recorded waveforms containing the syllables "u", "ma" and "i", but the recorded speech waveform storage unit 32 stores many recorded waveforms containing various syllables therein. A time length of each syllable depending on the recorded waveforms is stored in the time length information storage unit 31.

The segment waveform cutout unit 34 and the pitch waveform generation unit 35 are accomplished in a CPU of a computer operating according to a waveform processing program, for example.

The constituents provided in the prosody correction unit 2 and the segment waveform coupling unit 3 are the same as those in the first exemplary embodiment, and an explanation thereof will be omitted. The variants of the first exemplary embodiment may be applied to the second exemplary embodiment.

According to the present exemplary embodiment, the similar advantageous effects to those in the first exemplary embodiment can be obtained. The speech segment storage unit 1 may automatically store groups of pitch waveforms of various segments therein.

Third Exemplary Embodiment

Figure 9:
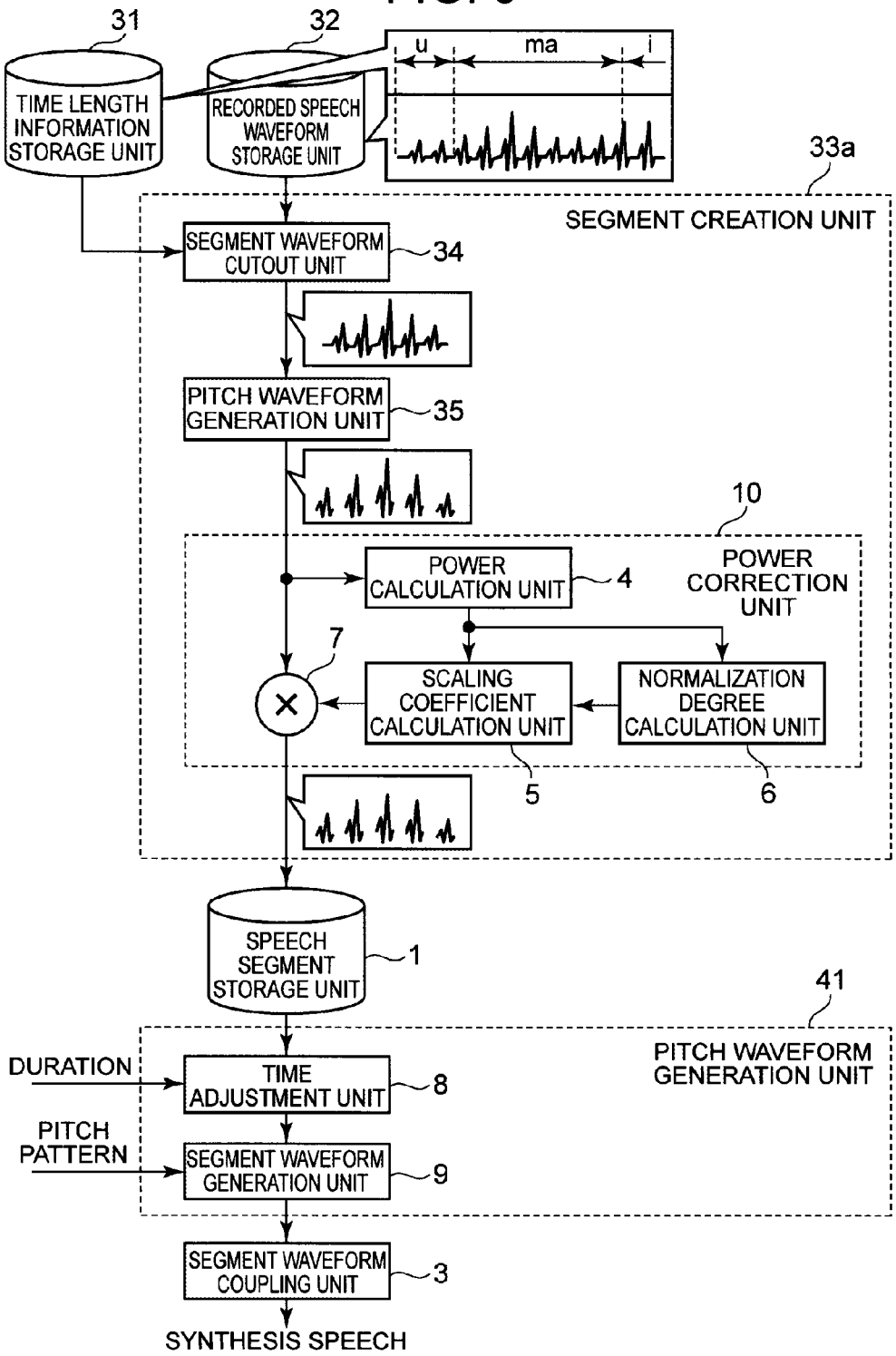
FIG. 9 It depicts a block diagram illustrating an example according to a third exemplary embodiment of the present invention.

FIG. 9 is a block diagram illustrating an example according to a third exemplary embodiment of the present invention. The same constituents as those in the first exemplary embodiment or the second exemplary embodiment are denoted with the same reference numerals as in FIG. 1 or FIG. 9, and a detailed explanation thereof will be omitted.

A waveform processing device according to the third exemplary embodiment includes the recorded speech waveform storage unit 32, the time length information storage unit 31, a segment creation unit 33*a*, the speech segment storage unit 1, a pitch pattern generation unit 41, and the segment waveform coupling unit 3.

According to the present exemplary embodiment, the segment creation unit 33*a* scales the groups of pitch waveforms before being stored in the speech segment storage unit 1, and stores the groups of scaled pitch waveforms in the speech segment storage unit 1.

The pitch waveform generation unit 41 couples the pitch waveforms stored in the speech segment storage unit 1 per segment.

The segment creation unit 33*a* includes the segment waveform cutout unit 34, the pitch waveform generation unit 35, and the power correction unit 10. The segment waveform cutout unit 34 and the pitch waveform generation unit 35 are the same as those in the second exemplary embodiment, respectively. The power correction unit 10, and the power calculation unit 4, the normalization degree calculation unit 6, the scaling coefficient calculation unit 5 and the multiplier 7 included in the power correction unit 10 are the same constituents as those in the first and second exemplary embodiments. The multiplier 7 stores groups of scaled pitch waveforms in the speech segment storage unit 1.

The pitch waveform generation unit 41 includes the time adjustment unit 8 and the segment waveform generation unit 9. The time adjustment unit 8, the segment waveform generation unit 9, and the segment waveform coupling unit 3 are the same constituents as those in the first and second exemplary embodiments.

Also in the present exemplary embodiment, the similar advantageous effects to those in the second exemplary embodiment can be obtained.

Figure 10:
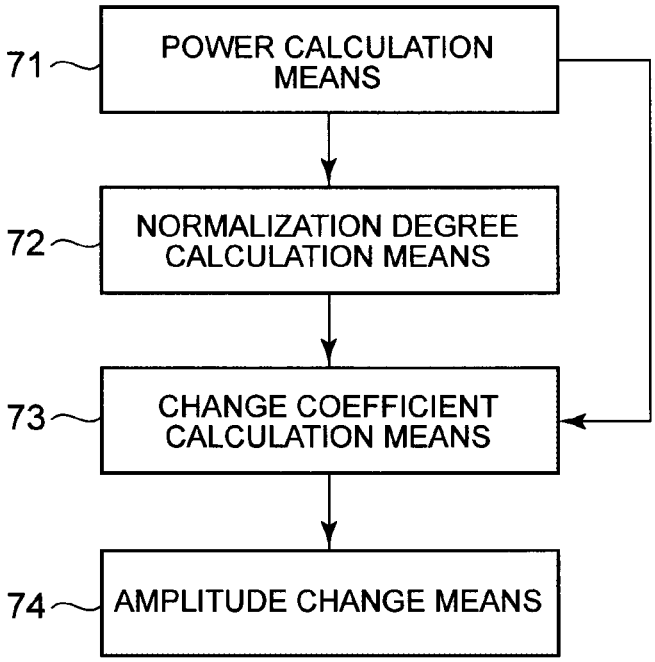
FIG. 10 It depicts a block diagram illustrating an exemplary minimum structure of a waveform processing device according to the present invention.
Figure 11:
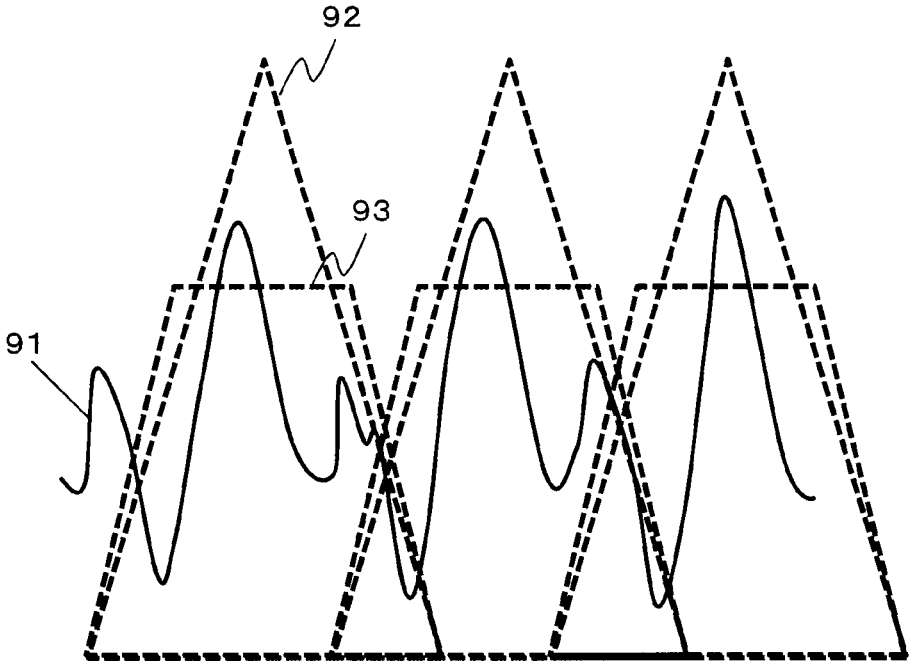
FIG. 11 It depicts a schematic diagram illustrating an exemplary compression processing on waveforms of a speech.

A minimum structure of the present invention will be described below. FIG. 10 is a block diagram illustrating an exemplary minimum structure of a waveform processing device according to the present invention. The waveform processing device according to the present invention includes a power calculation means 71, a normalization degree calculation means 72, a change coefficient calculation means 73, and an amplitude change means 74.

The power calculation means 71 (such as the power calculation unit 4) selects pitch waveforms one by one from a group of pitch waveforms corresponding to a segment, and calculates a scalar indicating power of a selected pitch waveform (such as average amplitude, or scalar obtained in Equation (7) or Equation (8)).

The normalization degree calculation means 72 (such as the normalization degree calculation unit 6) calculates a degree of normalization which is an index indicating a degree of normalization of a pitch waveform selected by the power calculation means 71, as a function value of an increasing function (such as the function A(S) expressed in Equation (4), Equation (9) or Equation (10)) with the scalar as a variable.

The change coefficient calculation means 73 (such as the scaling coefficient calculation unit 5) calculates a change coefficient (such as a scaling coefficient g) for changing an amplitude value of a pitch waveform selected by the power calculation means 71 based on the scalar and the degree of normalization.

The amplitude change means 74 (such as the multiplier 7) multiplies an amplitude at each sampling point of a pitch waveform selected by the power calculation means 71 by a change coefficient.

With the above structure, the power of each pitch waveform of a segment can be changed in order to obtain a natural synthesis speech.

Part of or all the embodiments may be described in the following supplementary notes, but are not limited to the following.

(Supplementary Note 1)

A waveform processing device including a power calculation means for selecting pitch waveforms one by one from a group of pitch waveforms corresponding to a segment, and calculating a scalar indicating power of a selected pitch waveform, a normalization degree calculation means for calculating a degree of normalization which is an index indicating a degree of normalization of a pitch waveform selected by the power calculation means, as a function value of an increasing function using the scalar as a variable, a change coefficient calculation means for calculating a change coefficient for changing an amplitude value of a pitch waveform selected by the power calculation means based on the scalar and the degree of normalization, and an amplitude change means for multiplying an amplitude at each sampling point of a pitch waveform selected by the power calculation means by the change coefficient.

(Supplementary note 2) The waveform processing device according to supplementary note 1, wherein assuming a change coefficient g, a predefined constant C, a scalar S calculated by the power calculation means, and a degree of normalization $\alpha$, the change coefficient calculation means calculates a change coefficient g meeting $(C/S) \leq g \leq 1.0$ as a function value of a function using the variables S and $\alpha$.

(Supplementary note 3) The waveform processing device according to supplementary note 1 or 2, including a segment waveform generation means for generating a waveform indicating a segment by coupling pitch waveforms changed by the amplitude change means.

(Supplementary note 4) The waveform processing device according to any one of supplementary notes 1 to 3, including a segment waveform coupling means for coupling waveforms indicating a segment generated by the segment waveform generation means.

(Supplementary note 5) The waveform processing device according to any one of supplementary notes 1 to 4, including a segment storage means for storing a group of pitch waveforms corresponding to a segment per segment.

(Supplementary note 6) The waveform processing device according to any one of supplementary notes 1 to 5, including a recorded speech waveform storage means for storing waveforms of a recorded speech, a segment waveform cutout means for cutting out a waveform of the recorded speech per segment, and a pitch waveform generation means for cutting out a waveform cut out per segment per pitch waveform, and generating a group of pitch waveforms corresponding to a segment per segment.

(Supplementary note 7) A waveform processing method including the steps of selecting pitch waveforms one by one from a group of pitch waveforms corresponding to a segment and calculating a scalar indicating power of a selected pitch waveform, calculating a degree of normalization which is an index indicating a degree of normalization of a selected pitch waveform, as a function value of an increasing function using the scalar as a variable, calculating a change coefficient for changing an amplitude value of a selected pitch waveform based on the scalar and the degree of normalization, and multiplying an amplitude value at each sampling point of a selected pitch waveform by the change coefficient.

(Supplementary note 8) The waveform processing method according to supplementary note 7, including the step of, assuming a change coefficient g, a predefined constant C, a scalar S indicating power of a selected pitch waveform, and a degree of normalization $\alpha$, calculating a change coefficient g meeting $(C/S) \leq g \leq 1.0$ as a function value of a function using the variables S and $\alpha$.

(Supplementary note 9) A waveform processing program for causing a computer to perform a power calculating processing of selecting pitch waveforms one by one from a group of pitch waveforms corresponding to a segment, and calculating a scalar indicating power of a selected pitch waveform, a normalization degree calculation processing of calculating a degree of normalization which is an index indicating a degree of normalization of a pitch waveform selected in the power calculation processing, as a function value of an increasing function using the scalar as a variable, a change coefficient calculation processing of calculating a change coefficient for changing an amplitude value of a pitch waveform selected in the power calculation processing based on the scalar and the degree of normalization, and an amplitude change processing of multiplying an amplitude value at each sampling point of a pitch waveform selected in the power calculation processing by the change coefficient.

(Supplementary note 10) The waveform processing program according to supplementary note 9, for causing a computer to, assuming a change coefficient g, a predefined constant C, a scalar S calculated in the power calculation processing, and a degree of normalization $\alpha$, calculate a change coefficient g meeting $(C/S) \leq g \leq 1.0$ as a function value of a function using the variables S and $\alpha$.

(Supplementary note 11) A waveform processing device including a power calculation unit for selecting pitch waveforms one by one from a group of pitch waveforms corresponding to a segment, and calculating a scalar indicating power of a selected pitch waveform, a normalization degree calculation unit for calculating a degree of normalization which is an index indicating a degree of normalization of a pitch waveform selected by the power calculation unit, as a function value of an increasing function using the scalar as a variable, a change coefficient calculation unit for calculating a change coefficient for changing an amplitude value of a pitch waveform selected by the power calculation unit based on the scalar and the degree of normalization, and an amplitude change unit for multiplying an amplitude at each sampling point of a pitch waveform selected by the power calculation unit by the change coefficient.

(Supplementary note 12) The waveform processing device according to supplementary note 1, wherein assuming a change coefficient g, a predefined constant C, a scalar S calculated by the power calculation unit, and a degree of normalization $\alpha$, the change coefficient calculation unit calculates a change coefficient g meeting $(C/S) \leq g \leq 1.0$ as a function value of a function using the variables S and $\alpha$.

(Supplementary note 13) The waveform processing device according to supplementary note 1 or 2, including a segment waveform generation unit for generating a waveform indicating a segment by coupling pitch waveforms changed by the amplitude change unit.

(Supplementary note 14) The waveform processing device according to any one of supplementary notes 1 to 3, including a segment waveform coupling unit for coupling waveforms indicating a segment generated by the segment waveform generation unit.

(Supplementary note 15) The waveform processing device according to any one of supplementary notes 1 to 4, including a segment storage unit for storing a group of pitch waveforms corresponding to a segment per segment.

(Supplementary note 16) The waveform processing device according to any one of supplementary notes 1 to 5, including a recorded speech waveform storage unit for storing waveforms of a recorded speech, a segment waveform cutout unit for cutting out a waveform of the recorded speech per segment, and a pitch waveform generation unit for cutting out a waveform cut out per segment per pitch waveform, and generating a group of pitch waveforms corresponding to a segment per segment.

The present application claims the priority based on Japanese Patent Application No. 2011-158298 filed on Jul. 19, 2011, the disclosure of which is entirely incorporated herein by reference.

The present invention has been described above with reference to the exemplary embodiments, but the present invention is not limited to the exemplary embodiments. Those skilled in the art can variously change the structure and details of the present invention within the scope of the present invention.

INDUSTRIAL APPLICABILITY

The present invention is applicable to a waveform processing device for changing power of a waveform.

REFERENCE SIGNS LIST

1 Speech segment storage unit
2 Prosody correction unit
3 Segment waveform coupling unit
4 Power calculation unit
5 Scaling coefficient calculation unit
6 Normalization degree calculation unit
7 Multiplier
8 Time adjustment unit
9 Segment waveform generation unit
10 Power correction unit

The invention claimed is:

1. A waveform processing device comprising:
a processor; and
an interface coupled to the processor;
wherein the processor is configured to:
select pitch waveforms one by one from a group of pitch waveforms corresponding to a segment of a speech to be processed as synthesis speech;
calculate a scalar indicating power of a selected pitch waveform;
calculate a degree of normalization which is an index indicating a degree of normalization of a pitch waveform, as a function value of an increasing function using the scalar as a variable;
calculate a change coefficient for changing an amplitude value of the selected pitch waveform based on the scalar and the degree of normalization, wherein assuming a change coefficient g, a predefined constant C, a scalar S, and a degree of normalization $\alpha$, calculate the change coefficient g meeting $(C/S) \leq g \leq 1.0$ as a function value of a function using the variables S and $\alpha$; and
change an amplitude at each sampling point of the selected pitch waveform based on the change coefficient g to produce a modified pitch waveform,
wherein using the change coefficient g for changing the amplitude of the selected pitch waveform to produce the modified pitch waveform reduces unbalanced power in the modified pitch waveform.

2. The waveform processing device according to claim 1, wherein the processor is further configured to
generate a waveform indicating a segment by coupling pitch waveforms.

3. The waveform processing device according to claim 2, wherein the processor is further configured to
couple waveforms indicating a segment.

4. The waveform processing device according to claim 1, wherein the processor is further configured to
store a group of pitch waveforms corresponding to a segment per segment.

5. The waveform processing device according to claim 1, wherein the processor is further configured to:
store waveforms of a recorded speech;
cut out a waveform of the recorded speech per segment; and
cut out a waveform cut out per segment per pitch waveform; and
generate a group of pitch waveforms corresponding to a segment per segment.

6. A waveform processing method implemented in a processor having an interface coupled to the processor, the method comprising the steps of:
selecting pitch waveforms one by one from a group of pitch waveforms corresponding to a segment of a speech to be processed as synthesis speech and calculating a scalar indicating power of a selected pitch waveform;
calculating a degree of normalization which is an index indicating a degree of normalization of a selected pitch waveform, as a function value of an increasing function using the scalar as a variable;

calculating a change coefficient for changing an amplitude value of the selected pitch waveform based on the scalar and the degree of normalization, wherein assuming a change coefficient g, a predefined constant C, a scalar S, and a degree of normalization $\alpha$, calculating the change coefficient g meeting $(C/S) \leq g \leq 1.0$ as a function value of a function using the variables S and $\alpha$; and changing an amplitude value at each sampling point of the selected pitch waveform based on the change coefficient g to produce a modified pitch waveform, wherein using the change coefficient g for changing the amplitude of the selected pitch waveform to produce the modified pitch waveform reduces unbalanced power in the modified pitch waveform.

7. A non-transitory computer-readable recording medium coupled to a processor having an interface coupled to the processor in which a waveform processing program is recorded, the waveform processing program causing a computer to perform:

a power calculating processing of selecting pitch waveforms one by one from a group of pitch waveforms corresponding to a segment of a speech to be processed as synthesis speech, and calculating a scalar indicating power of a selected pitch waveform;

a normalization degree calculation processing of calculating a degree of normalization which is an index indicating a degree of normalization of a pitch waveform selected in the power calculation processing, as a function value of an increasing function using the scalar as a variable;

a change coefficient calculation processing of calculating a change coefficient for changing an amplitude value of the selected pitch waveform selected in the power calculation processing based on the scalar and the degree of normalization, wherein the waveform processing program causing a computer to, assuming a change coefficient g, a predefined constant C, a scalar S calculated in the power calculation processing, and a degree of normalization $\alpha$, calculate the change coefficient g meeting $(C/S) \leq g \leq 1.0$ as a function value of a function using the variables S and $\alpha$; and an amplitude change processing of changing an amplitude value at each sampling point of the selected pitch waveform selected in the power calculation processing by the change coefficient g to produce a modified pitch waveform, wherein using the change coefficient g for changing the amplitude of the selected pitch waveform to produce the modified pitch waveform reduces unbalanced power in the modified pitch waveform.

* * * * *